US005265778A

United States Patent [19]

Shehebar

[11] Patent Number: 5,265,778

[45] Date of Patent: Nov. 30, 1993

[54] METHOD OF MANUFACTURING REVERSIBLE PLEATED MATERIAL

[75] Inventor: Albert Shehebar, Brooklyn, N.Y.

[73] Assignee: Joujou Designs, Inc., New York, N.Y.

[21] Appl. No.: 928,805

[22] Filed: Aug. 13, 1992

[51] Int. Cl.[5] ..... D05B 1/00; A41H 43/00

[52] U.S. Cl. ..... 223/28; 223/34; 112/262.2; 112/132

[58] Field of Search ..... 223/33, 34, 35, 28, 223/38; 112/262.3, 132; 2/211

[56] References Cited

U.S. PATENT DOCUMENTS

| | | | |
|---|---|---|---|
| 1,231,139 | 6/1917 | Dickman | 223/33 |
| 2,791,779 | 5/1957 | Presson | 2/211 |
| 2,818,575 | 1/1958 | Mills | 2/211 |
| 2,898,601 | 8/1959 | Presson | 2/211 |
| 2,916,741 | 11/1959 | Weiser . | |
| 2,945,238 | 7/1960 | Weiser | 223/28 |
| 2,947,993 | 8/1960 | Donath . | |
| 3,545,655 | 12/1970 | Kraushofer | 223/35 |
| 3,731,321 | 5/1973 | Dyche | 2/211 |
| 4,198,202 | 4/1980 | Kleber | 223/33 |
| 4,662,008 | 5/1987 | Weiser | 2/211 |
| 5,137,190 | 8/1992 | Plaud | 223/33 |

FOREIGN PATENT DOCUMENTS

| | | |
|---|---|---|
| 557207 | 5/1958 | Canada . |
| 557208 | 5/1958 | Canada . |
| 571432 | 3/1959 | Canada . |
| 585270 | 10/1959 | Canada . |
| 585600 | 10/1959 | Canada . |
| 604943 | 9/1960 | Canada . |
| 1186092 | 2/1959 | France . |
| 1202013 | 1/1960 | France . |
| 1206509 | 2/1960 | France . |
| 1557103 | 2/1969 | France . |
| 635437 | 3/1962 | Italy . |
| 848308 | 9/1960 | United Kingdom . |
| 885207 | 11/1961 | United Kingdom . |
| 1247401 | 9/1971 | United Kingdom . |

*Primary Examiner*—Clifford D. Crowder
*Assistant Examiner*—Bibhu Mohanty
*Attorney, Agent, or Firm*—Gottlieb, Rackman & Reisman

[57] ABSTRACT

A method of manufacturing material having knife-pleats on either side, for use in manufacturing reversible knife-pleated garments such as skirts or dresses. Patterned material is woven with alternating narrow and wide sections, wherein each narrow section is identical in width to the next narrow section and each wide section is identical in width to the next wide section. A template is provided for use in stitching the layers of material together to form pleats. The template is also used in creating pleats from solid-colored material.

12 Claims, 8 Drawing Sheets

METHOD OF MANUFACTURING REVERSIBLE PLEATED MATERIAL

FIELD OF INVENTION

The subject matter of this invention relates generally to clothing, and more particularly to a method of manufacturing material having knife-pleats on either side, i.e. reversible knife-pleats, for use in manufacturing reversible knife-pleated garments such as skirts or dresses. The material presents a pleated appearance when either side of the material faces outwardly.

BACKGROUND OF THE INVENTION

Reversible knife-pleated garments have been manufactured and marketed for many years. The basic skirt construction is described in U.S. Pat. No. 2,791,779, issued May 14, 1957, and in U.S. Pat. No. 2,898,601, issued Aug. 11, 1959.

A reversible knife-pleated skirt is constructed such that both sides of the skirt present a finished, pleated appearance. Typically, the material forming the knife-pleat is gathered to form at least three overlapping layers. The pleats of one side of the skirt extend vertically from the waistband to the hem of the skirt. The pleats are partially constrained from opening in the upper portions of the skirt, i.e. those portions which fit around the hip portion of the wearer, by being sewn shut from below the waistband to the hipline. The stitch lines sewing the pleats shut on the upper portion of the skirt are hidden behind each pleat and thus are not exposed to view when this side of the skirt is acting as the outer side. When the other layer of the skirt is acting as the outer side, the upper waist portion of the skirt has a flat, non-pleated appearance, and the stitching holding the pleats together from the waistband to the hipline is visible. The lower portion of the skirt, from the hipline to the hem, is pleated, since it is the reverse side of the pleats on the opposing side of the skirt.

Conventional methods of constructing reversible knife-pleated skirts involve pleating several pieces of the same patterned material and then stitching these pleated pieces together to create one pleated skirt. Generally, the seamstress or tailor constructing the pleated skirt stitches the layers of material by following the grain of the patterned fabric. Conventional methods also rely on the seamstress or tailor to estimate the termination point of the stitching, which should be near the hipline of the skirt. Thus, when reversible pleated skirts are conventionally manufactured, the stitching itself is usually not disposed along a straight line, and each line of stitching does not necessarily terminate at the same point. This method is time-consuming and imprecise, since the grain of the patterned fabric may not follow a straight line.

Often, a plaid or striped pattern is used, in which one patterned section alternates or repeats with another complementary but differently patterned section. Many of the patterned bolts of fabric are woven by hand, and the repeat of the fabric is usually not internally consistent, i.e. each patterned section will not have the identical width as the next same patterned section. Moreover, each bolt of hand-woven patterned material generally contains differences from the next bolt of the same patterned material. Since the seamstress or tailor typically pieces together several pieces of pleated material to create one skirt, inconsistencies within the material itself and between each separate pleated piece create difficulties in the construction of the final product, a reversible pleated skirt. These inconsistencies also detract from the overall appearance of the pleated skirt. Thus, conventional methods of constructing a reversible pleated skirt are not well-suited to mass production.

BRIEF DESCRIPTION OF THE INVENTION

The current invention relates to a method of mass-producing material having reversible knife-pleats from one bolt of solid material, or from one bolt of patterned material in which the repeat of the pattern is internally consistent. The current invention also provides for an improved method of manufacturing material having reversible knife-pleats from patterned material in which the repeat of the pattern is not internally consistent.

In accordance with this first aspect of the invention, material with either a stripe or plaid pattern is woven (either by hand or by machine) such that two complementary but differently patterned sections repeat or alternate with one another, and each repeated section is identical in width to the next same repeated section. This material is used to manufacture the pleated portion of the reversible pleated skirt—there is no need to piece together other pleated pieces of fabric to create one skirt.

Before folding the material to form pleats, each seamstress or tailor is given a template to use as a guide in stitching the pleats. Use of the template solves the problem of stitching the pleats by eye, by following the grain of the fabric. The template is constructed of a material that is stiff and will not bend, such as cardboard. The template is designed with a rectangular shape, having a top edge which is wider than the bottom edge, one straight side and an opposite tapered side. The dimensions of the template are calculated according to a specific formula, which depends upon the width of each repeated section, as well as the formation of pleats which are identical in width. Thus, a specified change in the number of pleats will result in a specific measurable increase in the overall waist of the reversible skirt, such that different skirt sizes can be easily produced by adding or deleting pleats.

The template also enables the manufacture of reversible pleated material for garments, including skirts and dresses, using material which is not patterned—i.e. which presents a solid color. Conventional methods of manufacturing reversible pleated skirts, where the seamstress or tailor follows the pattern of the fabric, cannot be used with solid-colored material because there is no pattern to follow when stitching. When the template is used, the seamstress or tailor follows the edge of the template in stitching the pleats rather than the pattern of the fabric.

In order to create pleats on a patterned bolt of material, the seamstress or tailor starts from the right side of the bolt of material and folds it over at the mid-point of the first wide repeated or alternating section. Then the seamstress or tailor places the template over the two layers of fabric such that the template's straight side is adjacent to the folded edge of the fabric, and the template's top edge meets the top edge of the fabric. The seamstress or tailor then stitches through two layers of fabric along the entire length of the tapered side, resulting in a straight stitch of the exact desired length.

Next, the seamstress or tailor removes the template and pulls back the top layer of fabric, which comprises a narrow repeated section, such that the narrow repeated section overlies the two stitched layers, creating a pleat with three overlapping layers of material. The narrow repeated section lies adjacent to the next narrow repeated section, creating the visual effect of the same pattern facing outwardly. The complementary pattern is unseen, folded within the overlapping fabric layers of the pleat. The seamstress or tailor then places a top stitch through three layers of fabric along the folded edge of the narrow repeat. The top stitch extends downwardly from the top edge of the fabric and terminates at the same point at which the tapered stitch terminates. Since the seamstress or tailor is now following the grain of the fabric, the seamstress or tailor may top stitch free-hand or use the straight edge of the template. Use of the template is preferred since it will result in a precise, straight stitch of the appropriate length.

The inventive method is repeated, using the entire bolt of material, in order to create the pleats for one reversible pleated skirt. When a solid bolt of material is used, having complementary colors on either side, or a solid color on one side and a complementary pattern on the other side, the seamstress or tailor must first measure and mark the fold lines, since there is no pattern to use as a guide. Then the steps described here are followed in order to create pleats which can be used to form a skirt or the bottom portion of a dress. Each pleated skirt is finished in the conventional manner with the placement of a waistband, a closing means (zipper or buttons), and stitching of the hem. If a dress is desired, the pleated material is affixed to the bodice of the dress using conventional techniques.

The final appearance of the reversible pleated skirt is quite pleasing. On one side of the skirt, pleats extend vertically in one pattern or color from the hipline to the hem. Above the hipline the material presents a flat appearance, with the top stitching apparent upon close examination, since the top stitch is made in thread which is color-matched to the pattern so that it does not detract from the pleasing appearance of the skirt. The tapered stitch lines sewing the pleats shut in the upper portion of the skirt are hidden behind the overlapping pleat folds. When the other side of the skirt acts as the outer skirt face, showing the complementary pattern or color, the skirt is pleated from waistband to hem, and both the top stitching and the tapered stitching are invisible.

Use of the template on patterned or solid material enables the manufacturer to quickly mass-produce reversible pleated skirts which do not contain major inconsistencies within the skirt itself or between one skirt and another skirt. Moreover, since the pleat size is identical in each skirt, the manufacturer can easily create different sizes of skirts by adding or subtracting a specified number of pleats.

The experienced seamstress or tailor may also fold the patterned or solid material as indicated here and place the stitches without using the template as a guide, by measuring the desired distance and angle required for each stitch and stitching by eye. However, use of the template is preferred since it ensures precision stitching.

If the patterned material used in manufacturing the reversible pleated skirt is not woven such that each narrow repeated section has an identical width and each wide repeated section has an identical width, a different sized tapered template must be used. The width of the top edge of the template is the same as the desired width of the pleat, measured near the waistband of the skirt. The bottom edge of the template has a width equal to the desired width of the pleat when measured at the hipline.

In accordance with this second aspect of this invention, in order to create pleats, the seamstress or tailor folds the material in an accordion-like manner, starting at the approximate mid-point of the first wide repeated section. The seamstress or tailor creates an overlapping layer by pulling back the fabric such that the first narrow repeated section lies adjacent to the next narrow repeated section, creating a pleat. Then, the seamstress or tailor places the folded fabric at a slight angle over the next adjacent narrow repeated section and uses the top edge of the second template to formulate the width of the pleat near the waistband, and uses the bottom edge of the pleat to formulate the width of the pleat near the hipline. Next, the seamstress or tailor places the template on the fabric, such that the straight side lies adjacent to the folded fabric edge. The seamstress or tailor then makes one stitch through the three layers of material downwardly along the folded edge, along the entire length of the template. The seamstress or tailor repeats this method, by which the fabric is folded in an accordion-like manner, until all the material has been utilized. This method is advantageous since it permits the manufacturer to use material which is not usable for the first method. Moreover, use of the template enables the seamstress or tailor to accurately create pleats of approximately the same size, and to make a series of precise, straight stitches, all of the appropriate length, without judging by eye. Since the width of each pleat is designed to be the same, this method also permits the easy manufacture of different sized skirts by simply adding or deleting pleats.

Moreover, this method permits the use of one bolt of material to create one skirt, without the need to piece together separate stitched and pleated sections which may not necessarily match-up. Lastly, since this method involves use of a template to make precise stitches to secure the pleats, it is faster than conventional methods which rely solely on the ability of the seamstress or tailor to make a straight stitch of the proper distance.

Accordingly, it is an object of this invention to provide a method of manufacturing material having reversible knife-pleats from one bolt of material which may be solid-colored or patterned on either side.

It is another object of this invention to provide an improved method of manufacturing material having reversible knife-pleats from one bolt of patterned material, which has narrow segments which are identical in width which alternate with complementary wide segments which are identical in width.

It is a further object of this invention to provide a method of manufacturing material having reversible knife-pleats from patterned material in which the repeats are not internally consistent.

It is a further object of this invention to provide the seamstress or tailor with a template to use in stitching the knife-pleats folded from the material.

DETAILED DESCRIPTION

Figure 1:
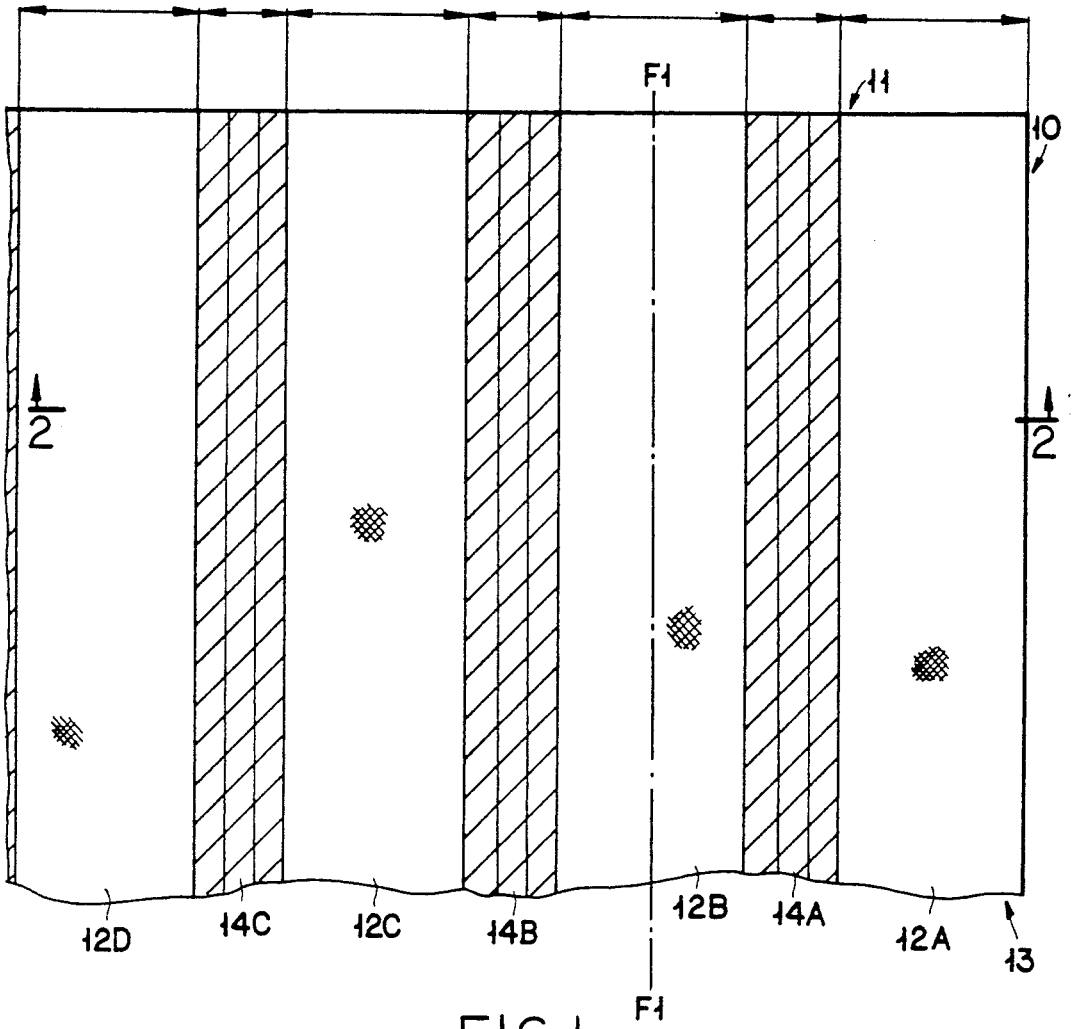
FIG. 1 is a front perspective view of patterned material used in forming reversible knife-pleats.

Referring to the drawings in detail, a reversible knife-pleated skirt 8 is manufactured from patterned fabric material 10 in accordance with the principles of the invention. When a patterned skirt 8 is desired, the pattern on both faces being stripes or plaid, the first step comprises weaving, either by hand or machine, patterned material 10 such as that depicted in FIG. 1, which has a top edge 11, a bottom edge 13, and two alternating sections 12 and 14. One section 12 is wider than the alternating section 14. For the purposes of this aspect of the inventive method of manufacturing material having reversible knife-pleats, it is essential that each alternating section 12 be identical in width to the next alternating section 12, depicted on FIG. 1 as 12A, 12B, 12C and 12D. Likewise, it is essential that each alternating section 14 be identical in width to the next alternating section 14, depicted in FIG. 1 as 14A, 14B, and 14C. If material 10 is woven such that alternating sections 12 and 14 are not internally consistent, this aspect of the inventive method described in detail below cannot be used to manufacture patterned reversible pleated skirts.

Figure 2:
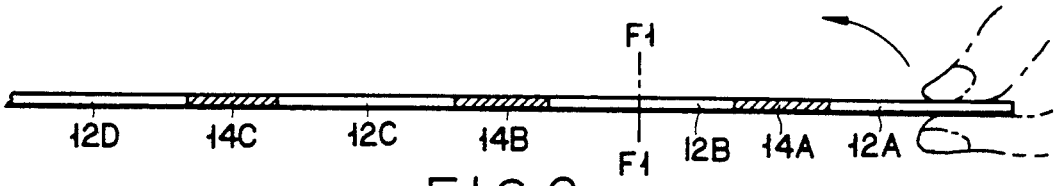
FIG. 2 is a cross-sectional view of the material in FIG. 1 taken along line 1—1.
Figure 4:
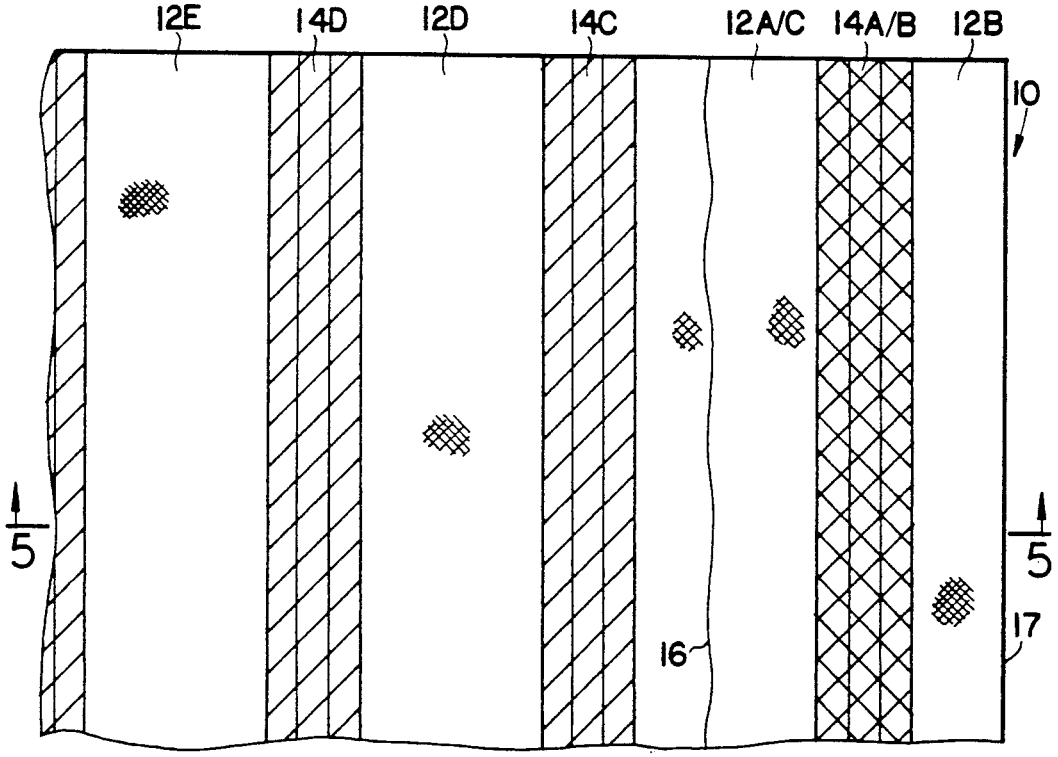
FIG. 4 is a front perspective view of the material depicted in FIG. 1 after the material has been folded.
Figure 5:
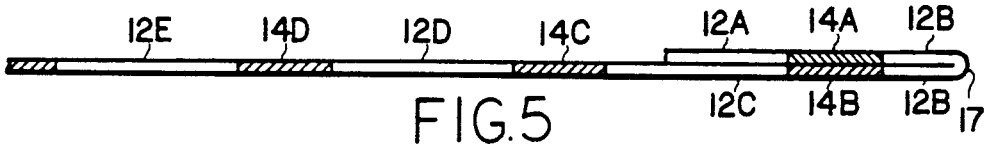
FIG. 5 is a cross-sectional view of the material in FIG. 4 taken along line 4—4.

Once material 10 has been properly woven, a bolt of material 10 at least 4 yards and 12 inches long and at least 20 inches wide is used to create reversible pleated skirt 8 having a length of 18 inches. The width of the fabric material is increased if a longer skirt length is desired, such as 33 inches. As seen in FIGS. 1 and 2, material 10 is folded along fold line F1, which lies in the middle of the second wide alternating section, or repeat, 12B, and which extends from top edge 11 to bottom edge 13. Thus, as depicted in perspective in FIG. 4 and in cross-section in FIG. 5, narrow section 14A lies directly on top of narrow section 14B, wide section 12A, which has a free side or edge 16, lies directly over wide section 12C, and wide section 12B, which is folded in half, has a vertical folded side or edge 17. Next, in the preferred method, the seamstress or tailor takes template 18, shown in FIG. 3, and places it on folded material 10 such that template top edge 20 is aligned with the top of folded material 10, template straight side 24 lies directly over folded side 17, and template tapered side 26 extends over combined narrow sections 14A and 14B. The seamstress or tailor then stitches diagonally through combined narrow sections 14A and 14B and folded section 12B along the entire length of tapered side 26 to form stitch line S1, as depicted in FIG. 6.

Figure 3:
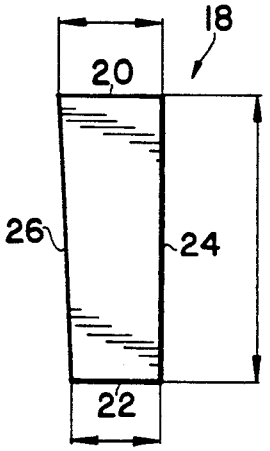
FIG. 3 is a front perspective view of the template used in forming material having reversible knife-pleats.
Figure 6:
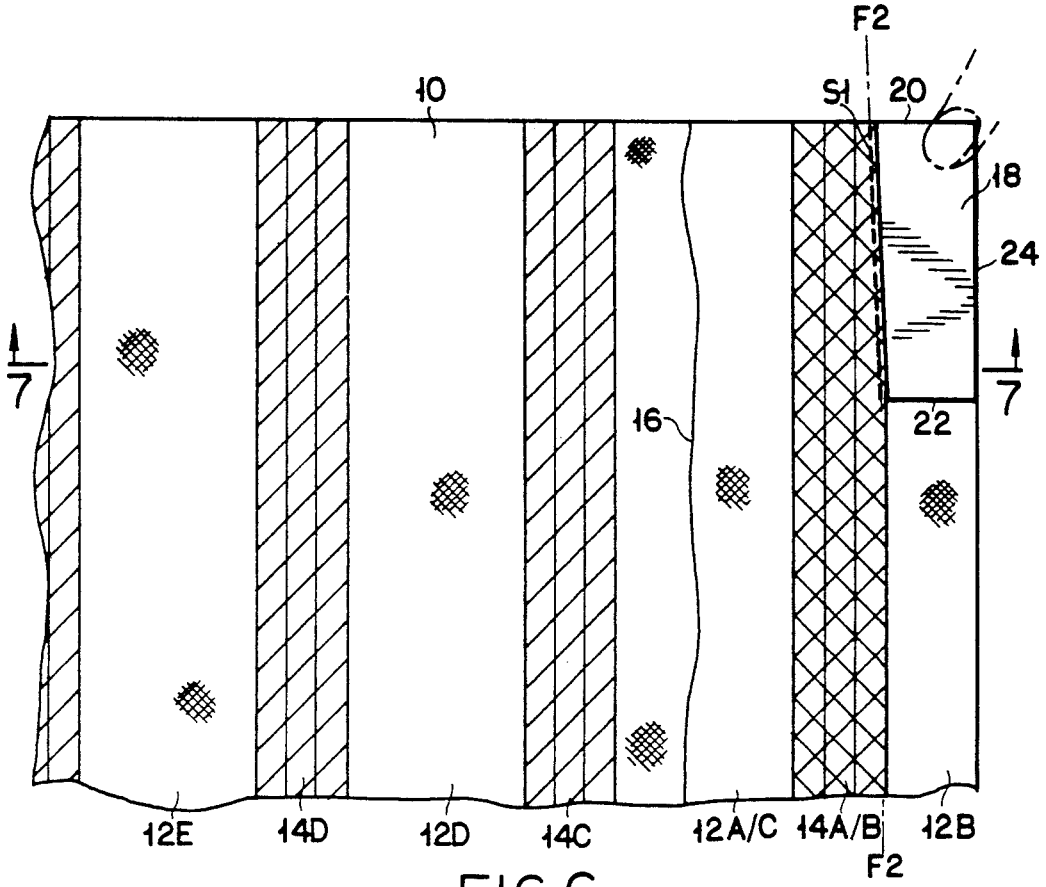
FIG. 6 is a front perspective view of the material in FIG. 4 having the template resting thereupon.

Through repeated testing, it was discovered that tapering or angling stitch S1 in stitching through a small portion of sections 14A and 14B, and a larger portion of folded section 12B, as shown in FIG. 6, rather than making a vertical stitch, ultimately created pleats which were narrower near the waistband and wider at the hip line, following the natural female form. Of course, a vertical stitch can also be used to create the pleats without departing from the inventive method. Accordingly, in the preferred method template 18 is constructed such that one side (26) is tapered and the opposite side (24) is straight, causing top edge 20 to be wider than bottom edge 22, as seen in FIG. 3. The exact dimensions of template 18 depend upon the width of alternating sections 12 and 14 and the desired width of the pleat near the waistband and are calculated according to the following formula:

$$\text{Top Width of Template} = \left(\frac{1}{2}\right)\left(\text{width of wide section}\right) + \frac{\left(\text{width of narrow section}\right) - \left(\text{pleat width near waistband}\right)}{2}$$

Figure 13A:
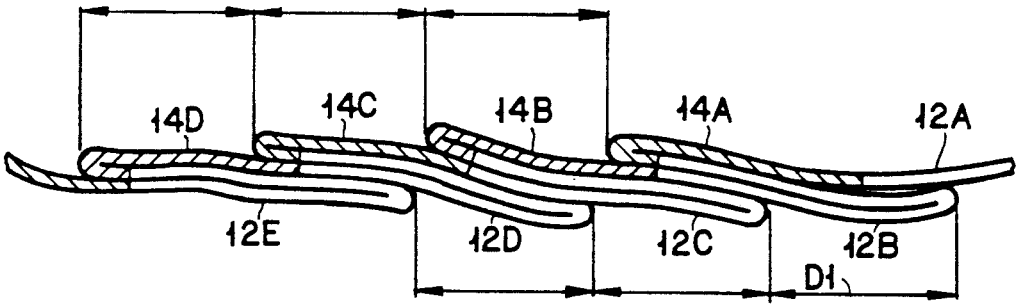
FIG. 13A is a cross-sectional view of the material along line 9—9 after four sections have been pleated.
Figure 14:
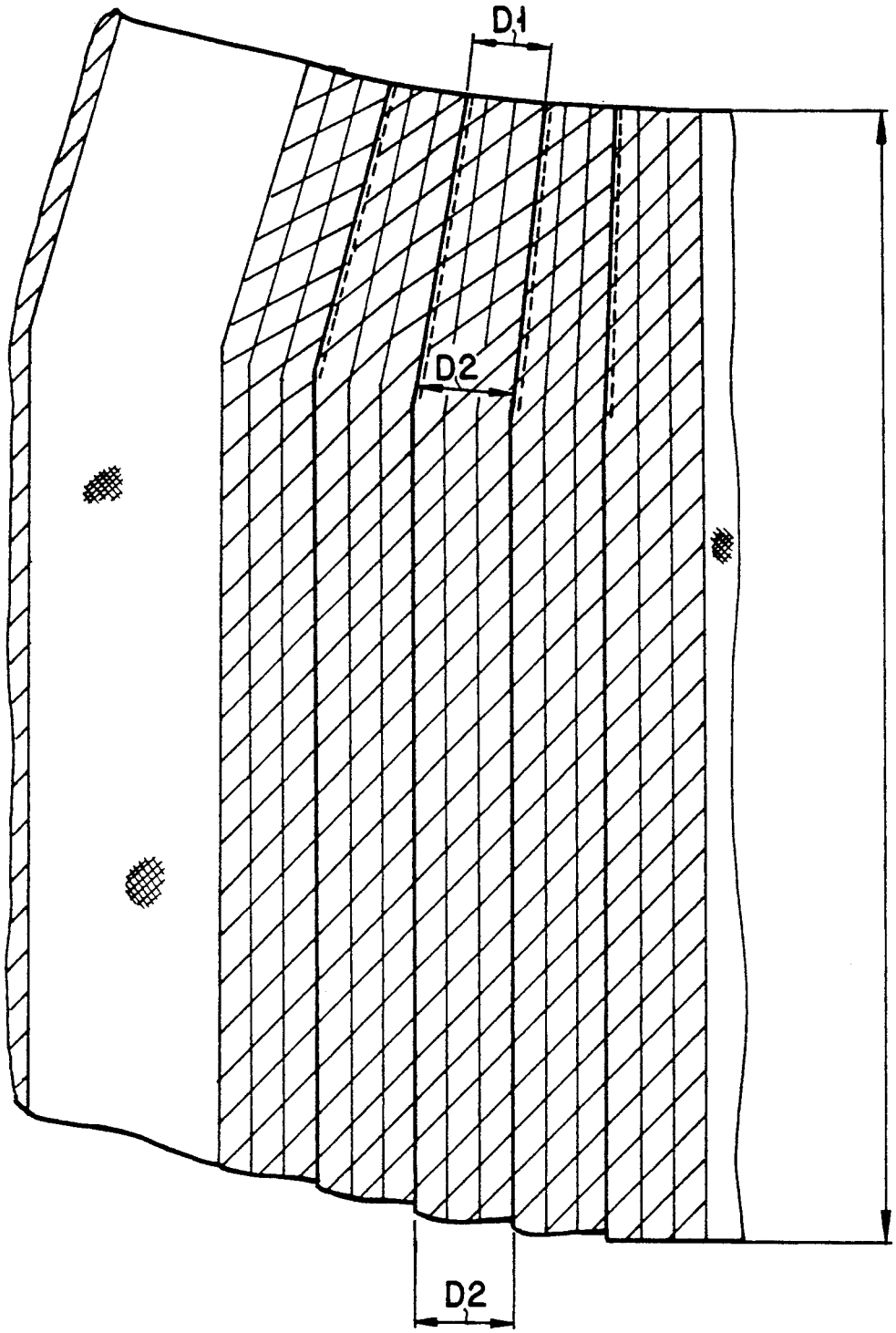
FIG. 14 is a front perspective view of one side of the material after a portion of the material has been pleated and stitched.

Since the sizes of skirts are generally measured in whole numbers, i.e. a size 7 skirt has a 27 inch waistband, the preferred width of finished pleats 30, measured near waistband 32 (shown as D1 in FIGS. 13A and 14) is one inch. Using a one inch waistband pleat measurement permits the easy manufacture of different-sized reversible skirts—the seamstress or tailor simply adds or subtracts pleats to create the desired size. Using a one inch pleat as a guideline and through repeated testing of pieces of patterned material having different widths for each alternating section, it was determined that the preferred width of wide section 12A through 12D is 3½ inches and the preferred width of narrow section 14A through 14C is 1¾ inches. Using these preferred dimensions in the above formula, the width of top edge 20 of template 18 is 2⅛ inches. Testing has also revealed that the minimum width for narrow section 14A through 14C is 1½ inches; any smaller width causes pleats 30 to open at hemline 36, revealing the hidden pattern and detracting from the pleasing appearance of skirt 8. (See FIGS. 15 and 16). Using the minimum measurement of 1½ inches for the narrow section 14A through 14C in the above formula, the width of top edge of template 18 becomes 2 inches. The length of straight side 24 of template 18 is preferably 6 inches, corresponding to the distance between waistband 32 and hipline 34 in most conventional pleated skirts. Thus, the angle between top edge 20 and tapered side 26 is approximately 94°.

Figure 13B:
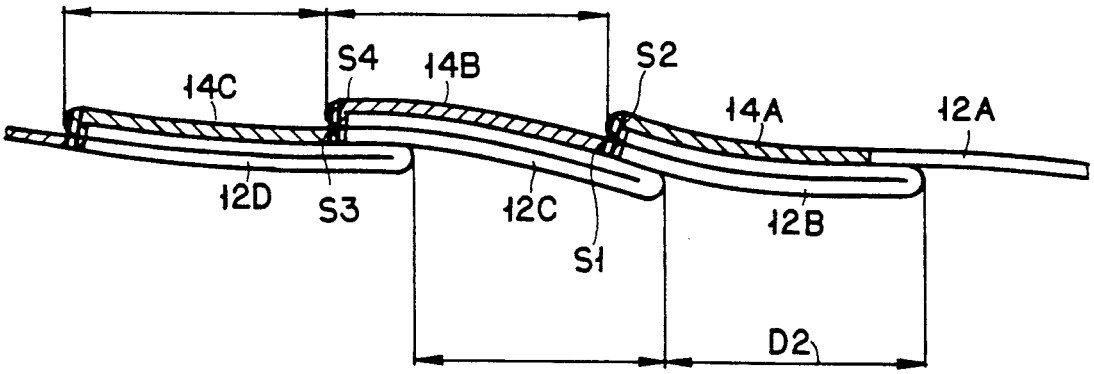
FIG. 13B is a cross-sectional view of the material along line 9A—9A after four sections have been pleated and stitched.
Figure 15:
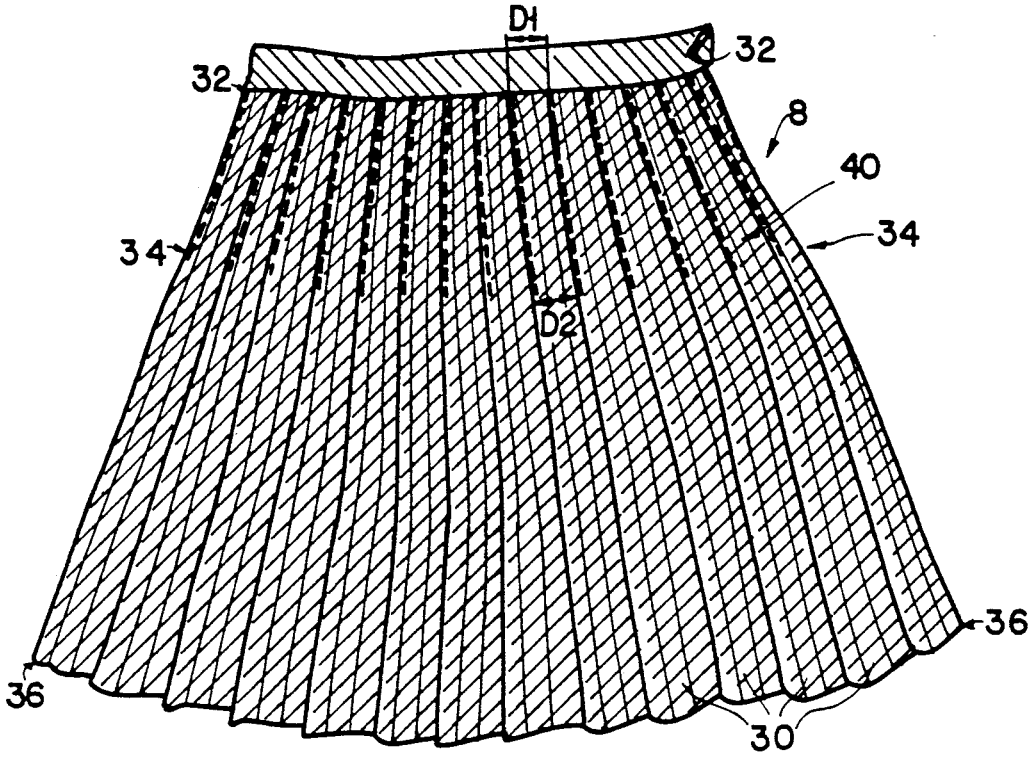
FIG. 15 is a front perspective view of one side of a reversible knife-pleated skirt manufactured from the material.
Figure 16:
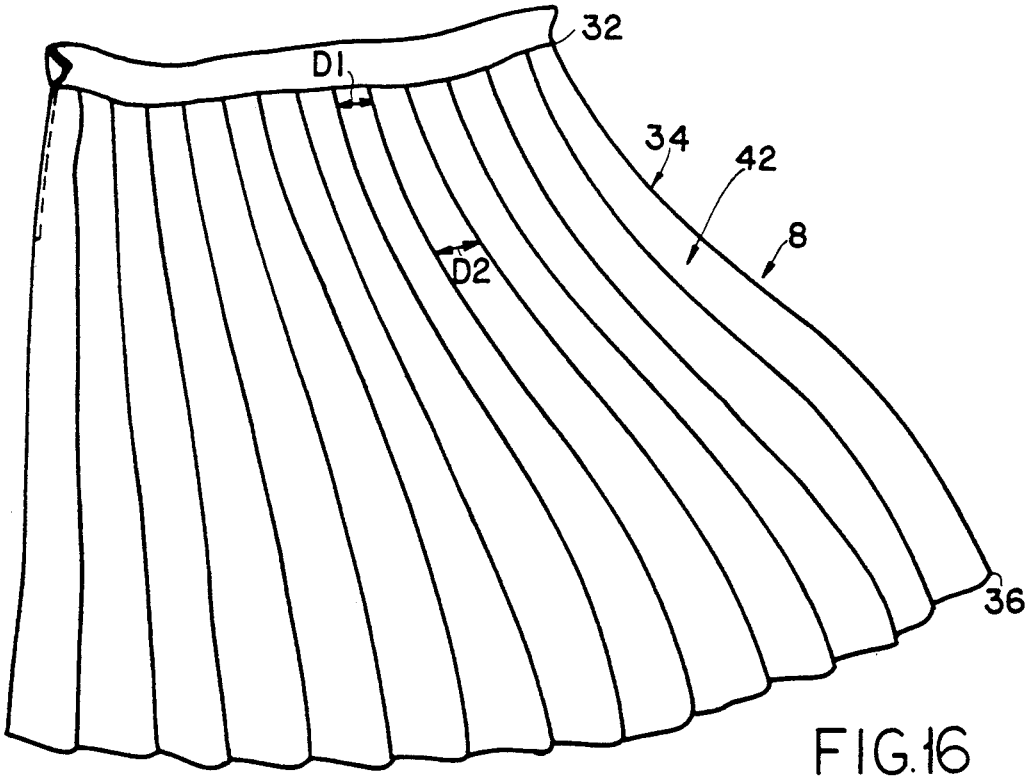
FIG. 16 is a front perspective view of the opposite side of the reversible knife-pleated skirt manufactured from the material.

The desired width of pleats 30, measured at hipline 34 or hemline 36 and marked as D2 on FIGS. 15 and 16, and in cross-section on FIG. 13B, is 1½ inches. This width results in pleats at hemline 36 which overlap each other by at least one-quarter inches, as depicted in FIG. 16, presenting a pleasing appearance for reversible pleated skirt 8. Thus, when top edge 20 of template 18 is 2⅛ inches wide, experimentation has shown that bottom edge 22 should be larger than the width of pleat 30 at hip line 34. The preferred range for bottom template edge 22 is from 1¾ to 1 7/8 inches, in order to allow for a ¼ inch overlap at hemline 36.

Figure 7:
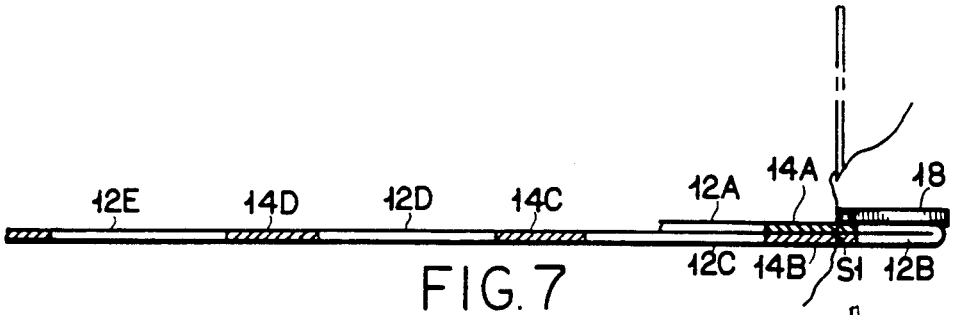
FIG. 7 is a cross-sectional view of the template and the material in FIG. 6 taken along line 6—6.
Figure 8:
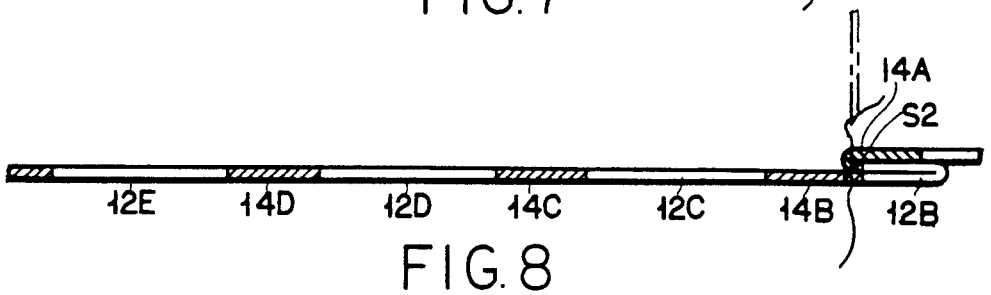
FIG. 8 is a cross-sectional view of the material in FIG. 6 taken along line 6—6 after the material has been stitched.
Figure 9:
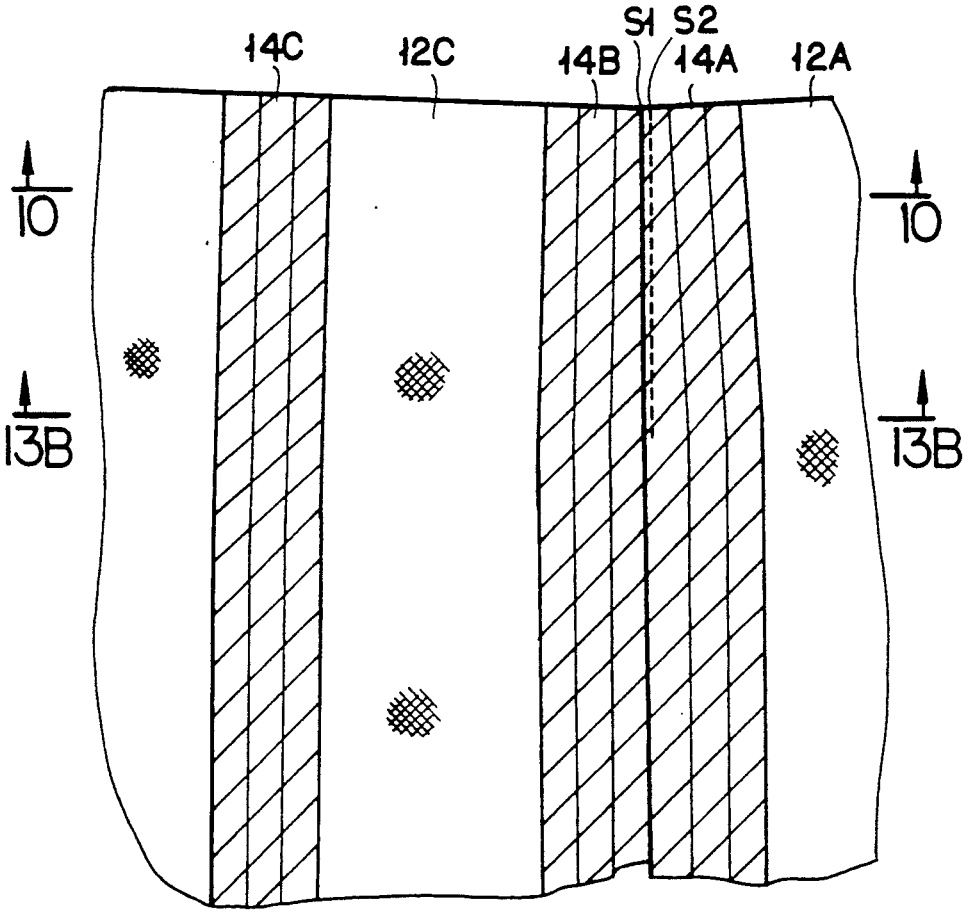
FIG. 9 is a front perspective view of the material after one section has been pleated and stitched.

Once the seamstress or tailor has stitched along tapered side 26 to create stitch S1, shown in perspective in FIG. 6 and in cross-section in FIGS. 7 and 8, the seamstress or tailor removes template 18 and pulls material 10 back in the opposite direction, along fold line F2, which lies closely adjacent to the right edge of section 14A, until stitch S1 interferes, such that section 14A slightly overlaps section 14B, as shown in cross-section in FIG. 8. Then, the seamstress or tailor places top stitch S2, using a 1/16th stitch, vertically along folded edge F2, shown in cross-section in FIG. 8. The seamstress or tailor preferably uses straight side 24 of template 18 as a guide in placing top stitch S2 along folded edge F2 of section 14A, so that each top stitch S2 will be straight and will terminate at the appropriate point. Here, the seamstress or tailor is stitching through three sections of material, specifically and in order, section 14A, section 12B and section 14B. As shown in FIG. 9, once stitching S2 and S1 have both been completed, narrow section 14A slightly overlaps section 14B. Stitching S1 is completely invisible from either face 40 or 42 of skirt 8 (see FIGS. 15 and 16) since it is completely covered by overlapping section 14A. To the contrary, stitching S2 is visible on this working face 40 of skirt 8, as seen in FIGS. 9 and 15. However, it is not visible on the opposite face 42 of skirt 8, since it will be covered by overlapping pleats 30, as seen in FIG. 16. Stitching S2 does not detract from the appearance of skirt 8 since thread is used which coordinates with the skirt's pattern.

Figure 10:
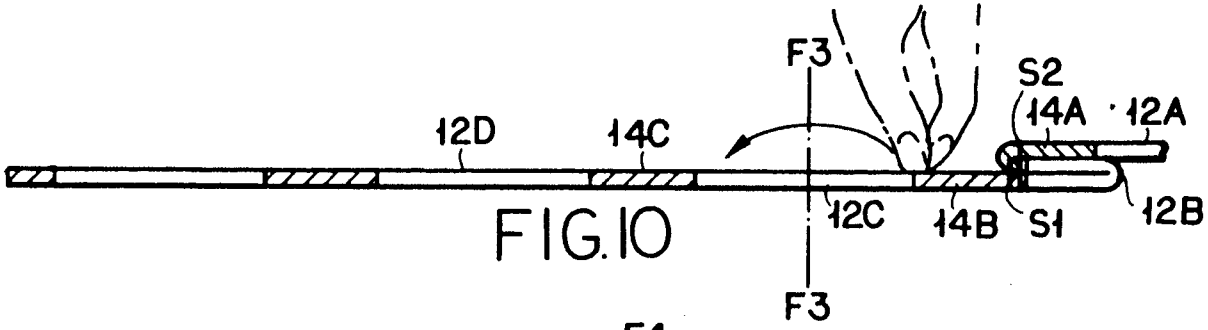
FIG. 10 is a cross-sectional view of the material in FIG. 9 taken along line 9—9 prior to the next fold.
Figure 11:
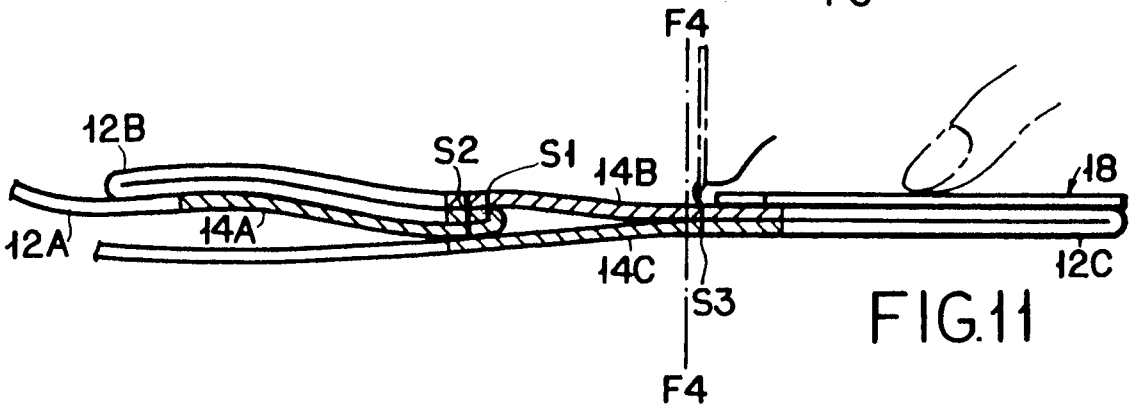
FIG. 11 is a cross-sectional view of the material in FIG. 9 along line 9—9 after the next fold has occurred and the template is resting thereupon.
Figure 12:
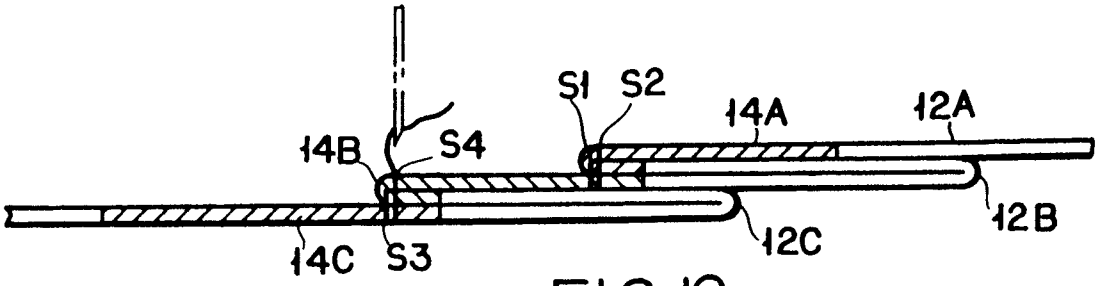
FIG. 12 is a cross-sectional view of the material along line 9—9 after two sections have been pleated and stitched.

FIGS. 10 through 13 depict in cross-section the effect of repeating the described steps of the inventive method on fabric 10. In FIG. 10, one pleat has been completely folded and stitched, such that wide section 12B has been doubled over and tapered stitch S1 has been placed to attach sections 14A and 14B together. Narrow section 14A overlies and is attached to doubled wide section 12B by top stitch line S2, which connects three layers of material—section 14A, section 12B and Section 14B. Next, the seamstress or tailor folds succeeding wide section 12C at the midpoint of that section, indicated by fold line F3. FIG. 11 depicts the material once it has been folded along fold line F3, and once template 18 has been placed on top of doubled section 12C. The seamstress or tailor stitches through doubled section 12C, following tapered side 24, creating stitching S3. Next, template 18 is removed and material 10 is folded back along fold line F4, adjacent to an edge of section 14B. Lastly, as depicted in cross-section in FIG. 12, top stitch S4 is placed through section 14B, section 12C and section 14C. The inventive method is repeated until enough of the bolt of material 10 has been pleated to create a reversible pleated skirt or skirt portion of a dress of the desired waist size. Then, skirt 8 is finished in the conventional manner, by affixing waistband 32 and a closing means, such as a zipper or buttons, and then stitching the hem. The reversibly pleated material can also be used as the skirt portion of a dress by attaching it in the conventional manner to the bodice of the dress.

The inventive method has been described herein with reference to a patterned material, either having stripes or plaid which are internally consistent. However, the method is equally adaptable to create material having reversible pleats where the material has one solid color on one side and another complementary solid color (or complementary pattern) on the opposite side. Creating such solid-colored reversibly pleated material using conventional methods, in which the seamstress or tailor places stitches by following the vertical stripes or grain of the fabric, is not possible since there is no grain to follow. In the inventive method, the seamstress or tailor takes a bolt of fabric, which has complementary colors on either side, and measures and marks the appropriate fold lines (which in the patterned fabric fall at the midpoint of each wide section) which appear every 3½ inches apart on material 10. Once the first fold is made, the seamstress or tailor places template 18 over the fabric so that straight edge 24 lies adjacent to the folded edge. Next, the seamstress or tailor stitches along the entire length of tapered side 26, removes the template and pulls back the fabric until stopped at the top by the tapered stitching. The seamstress or tailor then measures the fabric so that the pleat at the top will be one inch and the pleat at the hip line will be, preferably, 1½ inches. Then, the seamstress or tailor uses the straight side of the template to top stitch, with a 1/16 inch stitch, through three layers of fabric. The seamstress or tailor repeats the process to create the desired number of pleats.

An experienced seamstress or tailor may fold either patterned or solid material according to the principles of the invention and place both the tapered and top stitches without using the template as a guide, by measuring the desired stitch line distance and angle and stitching by eye. However, use of the template is preferred since it ensures precision stitching.

Use of the template in manufacturing either patterned or solid-color reversible pleated skirts has many advantages over conventional manufacturing methods, in which the seamstress or tailor simply folds the material in an accordion-like fashion, starting from the left side of the rectangular piece of material.

First, the fabric material is folded in a first direction along a predetermined fold line extending from the top edge of the material to the bottom edge, forming an overlying layer with a free edge and a folded edge. Next, the overlying layer is folded in the opposite direction along a second predetermined fold line extending from the top to the bottom edges of the fabric material, forming an overlying portion and an underlying portion. The doubled overlying layer and the underlying layer form a pleat—three overlapping layers of fabric material.

If a patterned piece of material is used, the first fold line is situated at the midpoint of the wider section, and the second fold line is situated at the junction between the folded wider section and the adjacent narrow section. The seamstress or tailor then follows the second fold line and stitches, by hand and not following a template, to a certain distance which should be approximately near the hipline of the skirt. Since the wide sections are not specially woven such that each narrow section is identical in width, merely folding the material by following the pattern and stitching by hand may cause pleats to be formed which are not equal in size when measured at the waistband level or at the hip level. Also, each stitch line may not terminate at the same point since the stitching is performed by hand. Moreover, practice of this method on solid-colored material is cumbersome since there is no pattern to follow when folding and no guide to use.

In contrast, use of the template on specially-woven internally consistent patterned material or on solid-color material enables mass production of material having reversible pleats in which the stitching is consistently straight and always terminates at the same point along the hipline. Conventional methods rely solely on the ability of the seamstress or tailor to stitch in a straight line and to judge where to stop stitching. Thus, in conventional methods the resulting reversible pleated material used to form the garment often contains many inconsistencies—the stitches are not necessarily straight and do not necessarily terminate at the same point at the hip line. Moreover, since the material is not specially woven to be internally consistent (the alternating sections in patterned material may not be consistent with one another) the resulting garment may have pleats which are not the same width, making it difficult to create a skirt which should be a certain number of whole inches wide. If the pleats themselves are not all the same size, it also detracts from the pleasing appearance of the skirt.

Conventional methods are improved upon by instructing the seamstress or tailor to use a template which has a top edge the same width as the desired waistband level pleat, a bottom edge the same width as the hipline pleat, a straight side and a tapered side. The seamstress or tailor uses the template to accurately prepare waistband level pleats 1 inch wide and hipline level pleats 1½ inches wide. Moreover, the seamstress or tailor uses the straight edge of the template in stitching the three layers of fabric together, either along the second fold line following the grain of the narrow repeat or section in a patterned piece of material, or along the folded edge on the solid-colored material. Use of the template enables the manufacturer to solve the prior art problem of relying upon the seamstress or tailor to consistently make a straight stitch and to determine where each line of stitching should terminate.

Although shown and described in what are believed to be the most practical and preferred embodiments, it is apparent that departures from the specific invention described and shown will suggest themselves to those skilled in the art and may be made without departing from the spirit and scope of the invention. I, therefore, do not wish to restrict myself to the particular methods described and illustrated, but desire to avail myself of all modifications that may fall within the scope of the appended claims.

I claim:

1. A method for constructing pleats along a fabric material having a top edge and a bottom edge comprising:

(a) folding said fabric material in a first direction along a predetermined fold line substantially extending from said top edge to said bottom edge for defining an overlying layer having a free edge and an underlying layer;

(b) wherein, a template having a straight side, a tapered side, and a top edge joining said sides which is wider than an opposing parallel bottom edge joining said sides, is placed over the overlying layer such that said template top edge is adjacent to said material's top edge and said template's straight side is aligned with said material's fold line; running a stitch through said layers from the top edge along a predetermined first stitch line located between said fold line and said free edge of said overlying layer;

(c) folding said first overlying layer in a second opposite direction along a second predetermined fold line located between said stitch line and said free edge for defining an overlying fabric portion and an underlying fabric portion of said overlying layer;

(d) running a second stitch through said underlying layer and said fabric portions of said overlying layer from the top edge along a second stitch line located adjacent to said second fold line; and (e) repeating steps a through d until all of said material has been pleated.

2. The method of claim 1, wherein one face of said material is solid-colored and the opposing face of said material bears a complementary solid color.

3. The method of claim 1, wherein one face of said material is solid-colored and the opposing face of said material bears a complementary pattern.

4. The method of claim 1, wherein one face of said material is patterned and the opposing face of said material bears a complementary pattern.

5. The method of claim 1, wherein in step b said first stitching is placed through said overlying and underlying layers of material by stitching along said template's tapered side from said template top edge to said template bottom edge.

6. The method of claim 5, wherein in step d said second stitching is placed through said underlying layer and said fabric portions by placing said template over said overlying layers such that said template straight edge is aligned with said second fold line and said template bottom edge is adjacent to said material's top edge and then stitching along said template's straight side from said template's bottom edge to said template's top edge.

7. The method of claim 6, wherein both faces of said material have a pattern having two alternating sections wherein said first section is wider than said second section, and each said first wide section is identical in width to the next said wide section and each said second narrow section is identical in width to the next said narrow section.

8. The method of claim 7, wherein in step a, said first fold line is situated at the mid point of said wide section.

9. The method of claim 8, wherein in step c said second fold line is situated adjacent to the junction between said narrow section and said folded wide section.

10. A method for constructing pleats along a fabric material having a top edge and a bottom edge comprising:

(a) folding said fabric material in a first direction along a predetermined fold line substantially extending from said top edge to said bottom edge for defining an overlying layer having a free edge and an underlying layer;

(b) folding said first overlying layer in a second opposite direction along a second predetermined fold line located between said first fold line and said free edge for defining an overlying fabric portion and an underlying fabric portion of said overlying layer;

(c) placing a template having a straight side, a tapered side, a top edge joining said sides which is narrower than an opposing parallel bottom edge joining said sides, over said overlying fabric portion such that said template top edge is adjacent to said material's top edge and said template's straight side is aligned with said second fold line;

(d) running a stitch through said underlying layer and said fabric portions of said overlying layer along said template straight side from said top template edge to said bottom template edge; and (e) repeating steps (a) through (d) until all of said material has been pleated.

11. The method of claim 10, wherein the width of each pleat is narrower at said top edge of said fabric material than at said bottom edge of said fabric material.

12. The method of claim 11, wherein said top edge of said template is equivalent in width to said top edge with of said pleat and said bottom edge of said template is equivalent in width to said bottom edge width of said pleat.

* * * * *